US009245437B2

(12) United States Patent
Best

(10) Patent No.: US 9,245,437 B2
(45) Date of Patent: Jan. 26, 2016

(54) CONTACT MONITORING SYSTEM

(75) Inventor: Kenneth Alaric Best, Lancaster (GB)

(73) Assignee: Kenneth Alaric Best, Lancaster, Lancashire (GB)

( * ) Notice: Subject to any disclaimer, the term of this patent is extended or adjusted under 35 U.S.C. 154(b) by 94 days.

(21) Appl. No.: 14/114,428

(22) PCT Filed: Apr. 26, 2012

(86) PCT No.: PCT/GB2012/000387

§ 371 (c)(1),
(2), (4) Date: Jan. 21, 2014

(87) PCT Pub. No.: WO2012/146896

PCT Pub. Date: Nov. 1, 2012

(65) Prior Publication Data

US 2014/0191876 A1 Jul. 10, 2014

(30) Foreign Application Priority Data

Apr. 26, 2011 (GB) ..... 1106928.3

(51) Int. Cl.

| | |
|---|---|
| ***G08B 21/00*** | (2006.01) |
| ***G08B 21/18*** | (2006.01) |
| ***G08B 13/14*** | (2006.01) |
| ***G08B 21/24*** | (2006.01) |

(52) U.S. Cl.

CPC ..... *G08B 21/18* (2013.01); *G08B 13/1427* (2013.01); *G08B 21/245* (2013.01)

(58) Field of Classification Search

CPC ..... G08B 21/245; G06F 19/327

USPC ..... 340/686.1, 539.12, 539.13, 573.1, 5.2, 340/5.83, 541, 567, 572.1–572.7

See application file for complete search history.

(56) References Cited

U.S. PATENT DOCUMENTS

| | | | | |
|---|---|---|---|---|
| 6,727,818 | B1 * | 4/2004 | Wildman et al. | 340/573.1 |
| 7,375,640 | B1 * | 5/2008 | Plost | 340/573.1 |
| 7,551,092 | B1 | 6/2009 | Henry | |
| 2002/0024443 | A1 | 2/2002 | Hawkins et al. | |
| 2003/0117281 | A1 | 6/2003 | Sriharto et al. | |
| 2006/0022823 | A1 | 2/2006 | Ryal | |
| 2006/0214795 | A1 | 9/2006 | Kim | |
| 2008/0001763 | A1 * | 1/2008 | Raja et al. | 340/573.1 |
| 2008/0007407 | A1 | 1/2008 | de Elia | |
| 2008/0126126 | A1 | 5/2008 | Ballai | |
| 2009/0267776 | A1 | 10/2009 | Glenn et al. | |

(Continued)

FOREIGN PATENT DOCUMENTS

| | | |
|---|---|---|
| EP | 1872802 | 1/2008 |
| WO | 2008041143 | 4/2008 |
| WO | 2010026581 | 3/2010 |

(Continued)

*Primary Examiner* — Tai T Nguyen

(74) *Attorney, Agent, or Firm* — Tarolli, Sundheim, Covell & Tummino LLP

(57) ABSTRACT

The present invention relates to a system for monitoring contact or close proximity between one or more sources of contact within an environment and to one or more devices suitable for implementing such a system. Each source of contact is provided with a monitoring device. Each monitoring device comprises an indicator unit and a detecting unit. The indicator unit is operable to emit a signal and the detecting unit is operable to detect and identify signals of the type emitted by the indicator unit of another monitoring device and output an information signal indicative thereof.

31 Claims, 6 Drawing Sheets

(56) References Cited

U.S. PATENT DOCUMENTS

| | | | | |
|---|---|---|---|---|
| 2010/0265061 | A1 | 10/2010 | Harmon et al. | |
| 2011/0254682 | A1 * | 10/2011 | Sigrist Christensen | 340/539.12 |

FOREIGN PATENT DOCUMENTS

| | | |
|---|---|---|
| WO | 2010070072 | 6/2010 |
| WO | 2010099488 | 9/2010 |

* cited by examiner

CONTACT MONITORING SYSTEM

FIELD OF THE INVENTION

The present invention relates to a system for monitoring contact or close proximity between one or more sources of contact within an environment and to one or more devices suitable for implementing such a system.

BACKGROUND OF THE INVENTION

In some environments, it is important to monitor the presence of certain persons within a particular location and also to monitor the contact between persons and equipment within a location. Such environments include areas where hygiene is of particular importance, such as hospitals or food preparation settings, and also manufacturing and product assembly areas and areas of restricted access. It is also important to track which equipment within a location has been used and on what is has been used. It is, however, difficult to maintain a record of such information.

An example of such a difficulty is illustrated by considering a product assembly line. Workers on an assembly line can each be assigned a designated task as part of the assembly of the desired product. Each worker may have a set number of tools and equipment for carrying out the task. If a task on the assembly line is not completed to an appropriate level, the resulting product may not comply with the necessary quality assurance standards. It is, however, very difficult to monitor a workers compliance with the necessary standards required for each set task. It is also difficult to monitor the nature of the tools and equipment used and the worker using them.

It is therefore an object of the present invention to provide a system that at least partially alleviates or overcomes the above problems.

SUMMARY OF THE INVENTION

According to a first aspect of the present invention, there is provided a system suitable for monitoring the contact between a plurality of sources of contact within an environment, the system comprising: a monitoring device connected to each source, each monitoring device comprising an indicator unit and a detecting unit, the indicator unit being operable to emit a signal and the detecting unit being operable to detect and identify signals of the type emitted by the indicator unit of another monitoring device and output an information signal indicative thereof.

In the system of the present invention, a monitoring device can detect contact between at least two sources in an environment. By detecting a signal emitted from an indicator unit, a detecting unit can output information indicative of the at least two sources of contact. The information signal output in response to the contact can thus enable ready and/or automatic monitoring of the contact or close proximity between of the at least two sources. Beneficially, this can enable the monitoring of characteristics of the contact between the at least two sources over time, for example monitoring the duration, quality and frequency of contact.

Each source may be fixed or mobile within the environment. Each source may be a person, an article or area as appropriate. The sources may comprise a mixture of persons, articles or areas. If a source is a person, the person may be a worker or visitor within the environment. If a source is an article, this may be an item of equipment for use within the environment. If a source is an area, this may be a storage area, restricted area or other area within the environment.

A monitoring device is connected to each source to be monitored within an environment. The monitoring device can detect the contact between at least two sources within the environment. The contact detected may be from a physical contact between at least two sources, such as a person touching an article or another person, or an article touching another article. Additionally or alternatively, the contact may result from the at least two sources being in a close proximity, such as a person and/or article entering an area, or a person and/or article coming within a sufficient distance from another person and/or article. Additionally or alternatively still, in some embodiments the contact may result from the at least two sources being in physical contact with an intermediary object. The intermediary object may be an item of equipment, a person, a tool or an installation. The intermediary object may not have a monitoring device connected thereto. In such embodiments, the intermediary object allows passage of a signal emitted by an indicator unit of a first source in physical contact with the intermediary object to a detecting unit of a second or further source also in physical contact with the intermediary object.

The indicator unit may emit a signal or signals indicative of the source. The signal may be indicative of the type of source. For example, the signal emitted by the indicator unit may identify the type or nature of the source to which it is connected. Each indicator unit may emit a signal unique to its source.

In some implementations, each indicator unit may be operable to emit a signal incorporating a unique identification code. The code can comprise information allowing for the detecting unit to identify the specific indicator unit if required. The information encoded within the signal can provide details relating to the source. For example, in a hygiene environment such as a hospital, a patient and worker may be the sources of contact. The information encoded within the signal emitted from the indicator unit associated with the patient may identify the medication requirements of the patient. In another example, in a manufacturing environment where a worker and a tool are the sources of contact, the information encoded within the signal emitted from the indicator unit associated with the tool may identify characteristics of the tool, such as for example its uses or its specification.

The detecting unit can detect a signal emitted by an indicator unit. To avoid false information, an information signal may only be output if the signal detected by the detecting unit is different to the signal emitted by the indicator unit of the same monitoring device. In some embodiments, the detecting unit may be operable to receive the signals emitted by all indicator units within the environment, identify the signal emitted by the indicator unit of the same monitoring device and not output an information signal indicative thereof. Alternatively, each detecting unit may be pre-programmed only to detect and identify signals emitted by an indicator unit of another monitoring device.

Further, a signal may only be detected if its signal strength exceeds a threshold level and/or the signal duration exceeds a preset period or by some other signal characteristic, e.g. a signal code. The threshold level may differ for different sources.

For some sources, the threshold level may include a determination of the contact quality. This may be based on the detected signal strength and/or duration. Additionally or alternatively, the determination of the contact quality may be based on or varied in response to other information encoded by the signal, a particular pattern of contact or any separate input thereto. For example, where the source of contact is a bolt that requires tightening, the contact between the bolt and a tool and/or worker may be determined to be high quality if the associated signal detected by the detecting unit on the tool and/or worker has a strength exceeding a predetermined level for a duration exceeding a predetermined period.

Additionally or alternatively, the determination of the contact quality may involve extracting additional information from the detected signal or another signal. In such cases, the indicator unit may monitor a contact using additional sensing means and output a signal indicative of the contact quality based on the output of the additional sensing means.

The detecting unit may classify the contact according to any suitable classification scheme. The contact classification scheme may have a number of different levels depending on any associated risk resulting from the contact. Such a risk may be the contamination of a person, tool, utensil or other article within the environment. For example, in a hygiene environment where contamination risk is an important consideration, the detecting unit may classify the contamination risk associated with a source. The risk may be classified as low, medium or high. The classification may be varied from one level to another in response to each contact.

The information signal may be directly or indirectly indicative of the contact between at least two sources.

The monitoring device may be provided with a status display unit for outputting a visual indication of contact between at least two sources. The status display unit may output a visual indication of the contact classification.

The indication displayed by the status display unit may take the form of a colour, pattern, text, symbol or any suitable combination thereof as required or desired. For example, the status display unit may output information indicative of the or each source of contact. Where the source is a patient in a hospital, the status display unit may output patient details, such as for example, medication requirements. Alternatively, the status display unit may output information relating to the correct usage of a tool in a manufacturing environment. Additionally or alternatively, the status display unit may indicate whether a tool to be used on an article is suitable for that purpose or not. Beneficially, such information can assist in preventing a person within an environment from performing a designated task incorrectly.

The status display unit may comprise one or more illuminable elements, which vary their illumination in response to variation in the information signal. The status display unit may comprise an LED display, a liquid crystal display, a simple lamp display or similar.

In some embodiments, the status display unit may be operable to change colour to indicate a different level of classification, such as an associated risk resulting from a contact. In such embodiments, red would indicate 'high' risk, amber/yellow would indicate 'uncertain' risk and green would indicate 'low' risk. In other embodiments, the status display unit may be operable to output a colour in response to contact between two sources. For example, where a tool is contacted with an item of equipment, red would indicate that the tool is incorrect for use with that item of equipment and green would indicate that the tool is suitable for purpose.

In some embodiments, the status display unit may be additionally or alternatively operable to output an audio indication of the contact between at least two sources. For example, this audio indication may be output periodically or continuously or in response to changes in contact classification. The audio indication and/or its mode of operation may be varied according to the contact classification. For example, the audio indication may be provided only when once source comes into contact or close proximity to a source it is not authorised to contact. In such an example, where the sources of contact comprise a tool and an item of equipment, an audio indication may be provided if the tool is not suitable for use with that item of equipment.

The status display unit may be an integral part of the monitoring device. Alternatively, the status display unit may comprise a separate article in communication with the monitoring device. In such cases, the communication may be by means of any suitable wired or wireless link. The status display unit may be suitable for affixing to the clothing of the worker, the surface of an article or a wall of an area as desired or appropriate.

The indicator unit may be operable to emit signal of more than one type. Such signals may, for example, comprise electrical signals and radio frequency signals.

In one embodiment, the signals emitted by the indicator unit are electrical signals. In such embodiments, signals can only be detected by the provision of an electrical pathway between the indicator unit and the detecting unit. This may be achieved if there is electrical contact between the sources. The electrical contact may be direct or indirect. Typically, the electrical contact between the sources may be temporary. Accordingly, the indicator unit and detecting unit are preferably directly or indirectly electrically connected to the monitoring device. The electrical signals may be low power signals. This can reduce or avoid the danger of electrocution or ignition.

In some embodiments, the electrical pathway between the indicator unit and the detecting unit includes an intermediary object capable of conducting the electrical signal. As referred to hereinbefore, the intermediary object may be an item of equipment, a person, a tool or an installation. The intermediary object may not have a monitoring device connected thereto.

In another embodiment, the signals emitted by the indicator unit are radio frequency signals. In such embodiments, signals can only be detected by sufficient proximity between the monitoring devices of at least two sources. The signals can be emitted by a radio frequency transmitter on the indicator unit. The radio frequency transmitter may be operable to emit a signal over any range from the source as desired or appropriate. The range may be adjustable.

The indicator unit may be operable to emit an electrical signal only or a radio frequency signal only. Alternatively, the indicator unit may comprise an electrical signal emitter and a radio frequency transmitter and thus be operable to emit either or both electrical and radio frequency signals.

The detecting unit may be operable to detect electrical signals only or radio frequency signals only. Alternatively, the detecting unit may comprise an electrical signal receiver and a radio frequency receiver and thus be operable to detect either or both electrical and radio frequency signals.

The monitoring device may be provided with attachment means enabling attachment to the source. The attachment means may further comprise one or more electrical surfaces enabling electrical connections to be made between the monitoring device and the source. Different forms of monitoring device or attachment means may be provided adapted for connection to different sources.

The system may further comprise a management unit. The management unit may be in one way or two way communication with one or more monitoring devices. The communication may be by way of any suitable wired or wireless link. In particular, the communication may be by way of a radio frequency link. In particular the or each monitoring device may be operable to transmit the information signal to the management unit by way of the communication link.

In some embodiments, this can allow the management unit to store a record of contact between two or more sources over time. This can be used for the purpose of conducting audits of contact history between two or more sources of contact within an environment. The record may comprise, for example, an identification of the source of contact, an indication of the date and duration of contact and other indicators as desired or as appropriate.

For example, within a manufacturing environment, each time a worker contacts a tool and/or equipment, an indicator unit on the tool and/or equipment may emit a signal of the type that can be detected by the detecting unit located on the worker. The detecting unit may output an information signal to the management unit. The information signal may have an incorporated identification code unique to the respective source. Thus, a record of the contact between a worker and the tool and/or equipment may be maintained by the management unit. The management unit may also store information encoded within the signal emitted by the indicator unit. The management unit may also be used to author protocols and appropriate to different conditions.

The management unit may be operable to transmit information to a status display unit, as hereinbefore described. The management unit may be in one way or two way communication with one or more status display units. The communication may be by way of any suitable wired or wireless link. The information transmitted to the status display unit may be extracted from the records stored by the management unit relating to the or each source of contact. For example, in a hygiene environment such as a hospital, a worker may come into contact or close proximity to a patient. The management unit may receive the signal transmitted by the monitoring device associated with the worker identifying the patient as the source of contact and transmit information from the stored records to the status display unit. Such information could, for example, identify the last worker to contact the patient. Alternatively, in a manufacturing environment the information transmitted by the management unit may identify the particular uses of a tool, the last time a tool was used on an item of equipment, and/or the last time the tool was calibrated.

The monitoring device may comprise a package. The package may be adapted to be either carried about a person, affixed to an article, or affixed to a wall of an area. The package may be provided with electrical contacts adjacent or in contact to the surface of the source, such as for example, a person's skin. Separate electrical contacts may connect the indicator unit and the detecting unit to the surface of the source.

According to a second aspect of the present invention there is provided a method of monitoring the contact between a plurality of sources of contact within an environment, the method comprising: attaching monitoring devices to or in proximity to each source, the monitoring devices each comprising an indicator unit and a detecting unit; detecting signals of the type emitted by an indicator unit with the detecting unit; and outputting an information signal indicative thereof.

According to a third aspect of the present invention there is provided a monitoring device suitable for monitoring the contact between a plurality of sources of contact within an environment, the monitoring device comprising: an indicator unit; a detecting unit; connection means for connecting the monitoring device to the source; wherein the detecting unit comprises a receiver operable to detect signals of the type emitted by the indicator unit; and a processing unit operable to identify the signal and output an information signal indicative thereof.

The second and third aspects of the present invention may incorporate any features described in respect of the first aspect of the present invention as desired or as appropriate.

BRIEF DESCRIPTION OF THE DRAWINGS

In order that the invention is more clearly understood, one possible implementation will now be described in more detail, by way of example only, and with reference to the accompanying drawings, in which: —

DETAILED DESCRIPTION OF THE INVENTION

The system of the present invention can be utilised in hygiene, manufacturing, maintenance or security environments. A person skilled in the art would appreciate that the invention could equally be applied to many other environments where monitoring contact between two or more sources of contact is required.

Figure 1:
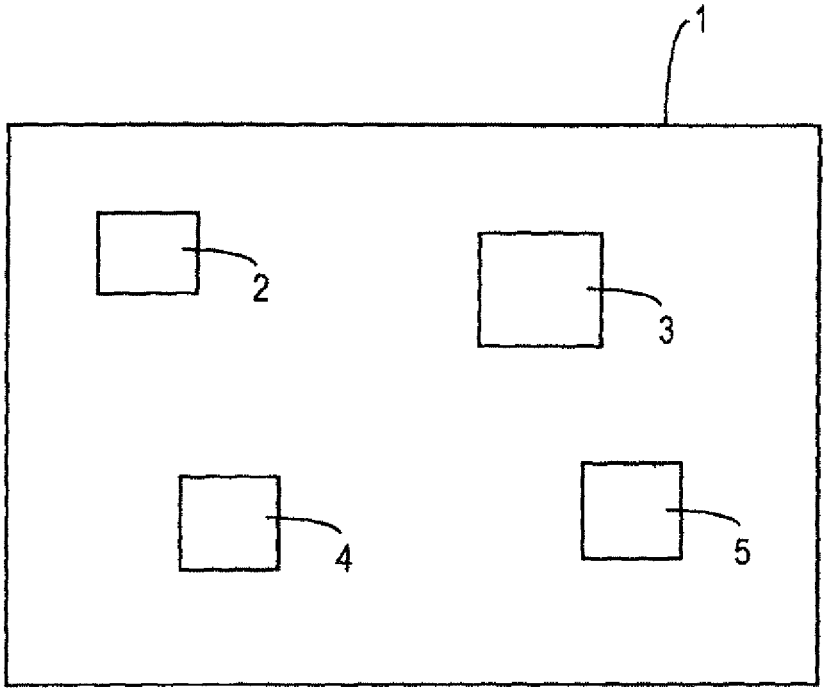
FIG. 1 is a schematic block diagram of an environment incorporating a system according to the present invention.
Figure 2:
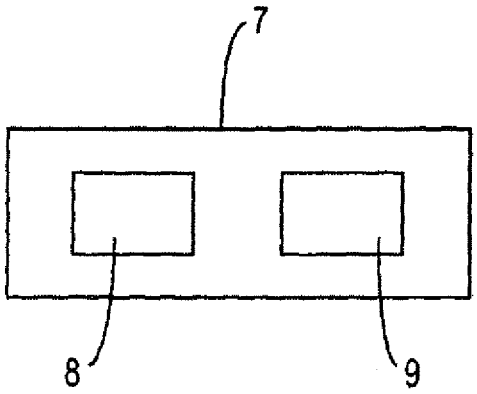
FIG. 2 is a schematic block diagram of an embodiment of a monitoring device according to the present invention.
Figure 3:
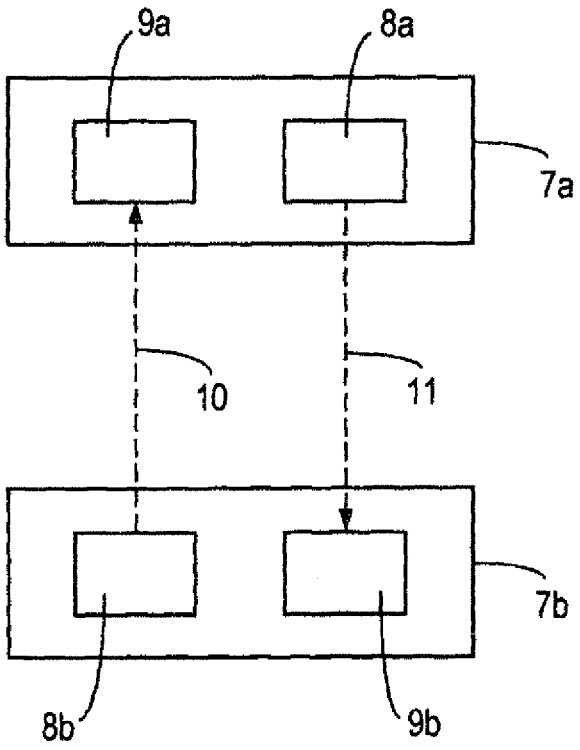
FIG. 3 is a schematic block diagram of a contact between two monitoring devices in a system according to the present invention.

Referring to FIGS. 1-3, there is shown an environment 1 comprising a number of sources of contact 2, 3, 4, 5 to be monitored. A person skilled in the art would appreciate that the present invention could equally apply to any number of sources of contact greater than one and is not limited to the sources 2, 3, 4, 5 shown in FIG. 1.

Each source of contact 2, 3, 4, 5 is provided with a monitoring device 7. Each monitoring device 7 comprises an indicator unit 8 and a detecting unit 9.

The indicator unit 8 is operable to apply a small electrical signal to the source 2, 3, 4, 5. The indicator unit 8 may additionally or alternatively emit a radio frequency signal. Each signal emitted is unique to the indicator unit 8 such that no indicator unit 8 emits an identical signal within the same environment 1. Accordingly, the signal emitted by each indicator unit 8 will be unique to the source of contact 2, 3, 4, 5 to which it is connected.

Two such sources 2, 3 are shown in FIG. 3. Each monitoring device 7*a*, 7*b* comprises respective indicator units 8*a*, 8*b* and detecting units 9*a*, 9*b*.

Each detecting unit 9*a*, 9*b* is operable to detect signals of the type emitted by the indicator units 8*a*, 8*b*. In order to avoid false contact information resulting from the detection by detecting unit 9 of electrical signals emitted by the indicator unit 8 of the same monitoring device 7, the detecting unit 9 can be pre-programmed to discount a signal received from the indicator unit 8 of the same monitoring device 7. As such, any signal detected by the detecting unit 9 will have originated from an indicator unit 8 of a monitoring device 7 attached to a different source of contact 2, 3, 4, 5.

As illustrated in FIG. 3, a signal 10 emitted by the indicator unit 8*b* associated with a source of contact 3 can be detected by the detecting unit 9*a* associated with a source of contact 2 to determine that contact has taken place between the sources 2,3. Correspondingly, a signal 11 emitted by the indicator unit 8*a* associated with a source of contact 2 can be detected by the detecting unit 9*b* associated with a source of contact 3 to also determine that contact has taken place between the sources 2,3.

Figure 4:
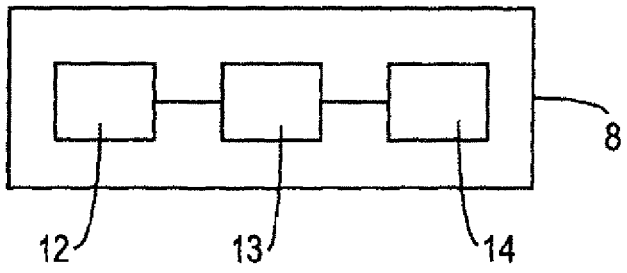
FIG. 4 is a schematic block diagram of an indicator unit.

As shown in FIG. 4, the indicator unit 8 comprises electrical contacts 12, an electrical signal emitter 13 and a memory 14. The electrical contacts 12 may be incorporated into an attachment means (not shown) for attaching the monitoring device 7 to a particular source 2, 3, 4, 5. The contacts 12 are adapted to make an electrical connection with the surface of a conducting portion of the selected source 2, 3, 4, 5.

The emitter 13 emits a signal onto the conducting portion of the selected source 2, 3, 4, 5 via the contacts 12. The signal encodes information stored in the memory 14. The information may be a code identifying the nature of the source 2, 3, 4, 5. Additionally or alternatively, the memory 14 may also be pre-programmed with a unique code containing information relating to the source 2, 3, 4, 5. The emitter 13 may also comprise a radio frequency emitter for emitting radio frequency signals.

Figure 5:
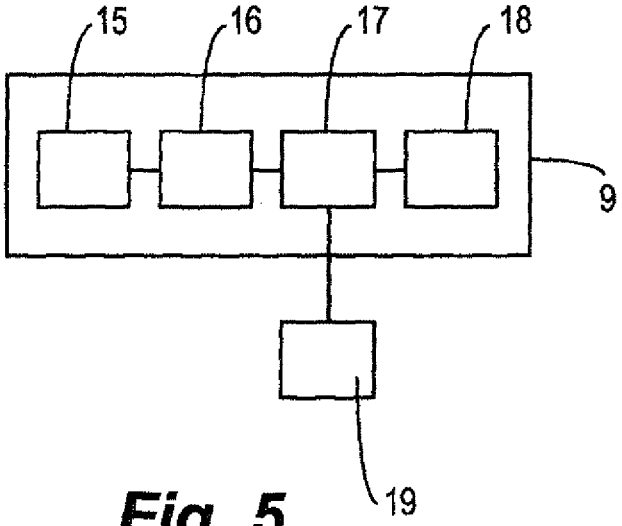
FIG. 5 is a schematic block diagram of a detecting unit.

As shown in FIG. 5, the detecting unit 9 comprises electrical contacts 15, a receiver 16, a processing unit 17 and a transmitter 18. The electrical contacts 15 may be incorporated into an attachment means (not shown) for attaching the monitoring device 7 to the source 2, 3, 4, 5. The contacts 15 are adapted to make an electrical connection with the surface of the source 2, 3, 4, 5. The contacts 15 are further connected to a receiver 16 which detects any electrical signals applied to the contacts 15. As noted above, the detecting unit 9 may be pre-programmed so as to ignore any signal emitted by the signal emitter 13 associated with the same source 2, 3, 4, 5 as itself.

The processing unit 17 is connected to the receiver 16 and is operable to identify any signals detected by the receiver 16. The processing unit 17 is operable to determine whether the signal emitted by an indicator unit 8 is of a different source 2, 3, 4, 5 to itself. The processing unit 17 can also determine the quality of the contact, if required or desired. In a simple embodiment, this may be achieved by determining whether the detected signal strength and/or duration exceed a predetermined threshold level.

Figure 6:
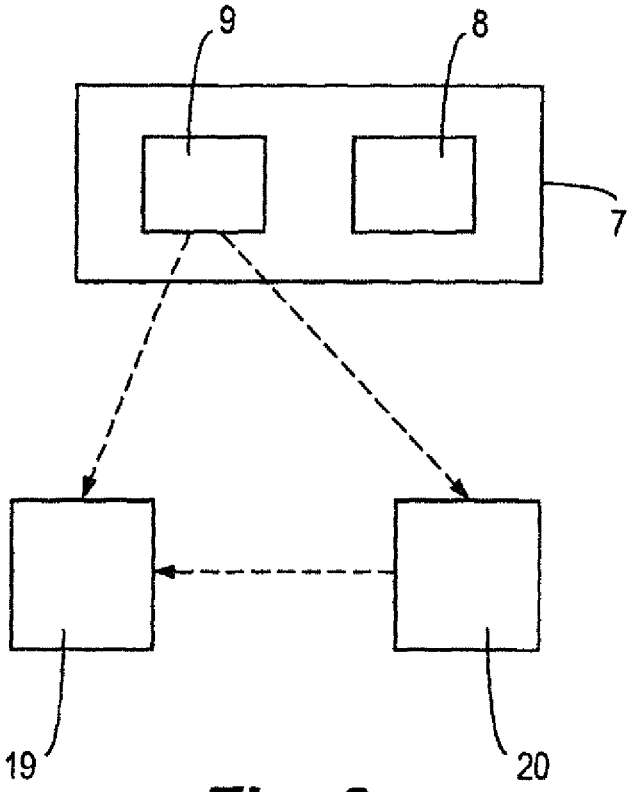
FIG. 6 is a schematic block diagram of an embodiment a part of the system of the present invention.

The processing unit 17 can output an information signal to the transmitter 18, which can transmit the information encoded therein to a management unit 20. Additionally or alternatively, the processing unit 17 can output an information signal to a status display unit 19. This is illustrated in FIG. 6.

The information output to the status display unit 19 may be indicative of the source of contact 2, 3, 4, 5. The information may comprise details of the source 2, 3, 4, 5. The management unit 20 comprises a record of the contact history of the sources 2, 3, 4, 5 in the environment over time. The records may identify the nature of the sources 2, 3, 4, 5 that come into contact and provide information indicative thereof, such as duration of contact. The management unit 20 can output information extracted from the records to the status display unit 19.

Figure 7:
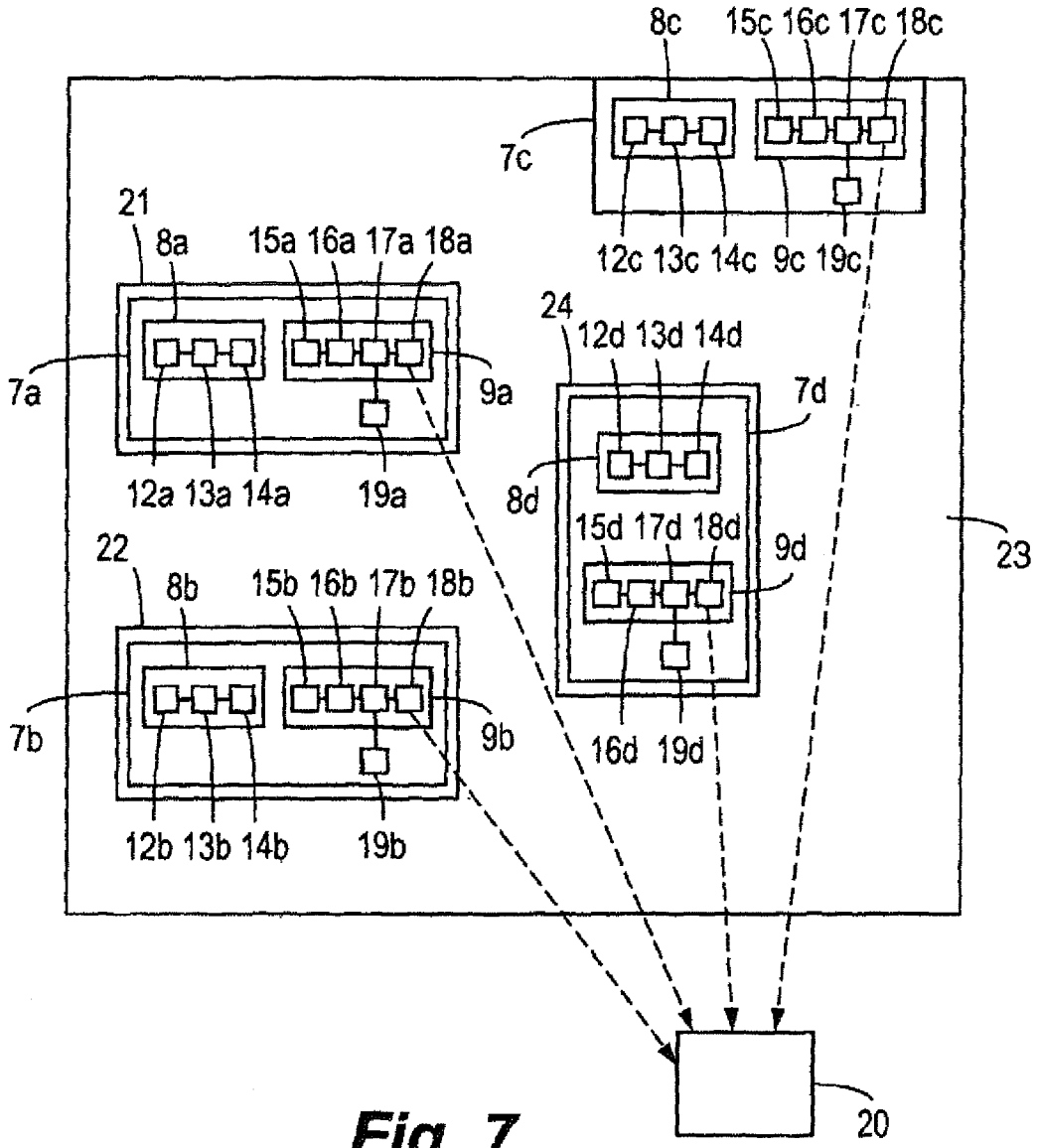
FIG. 7 is a schematic block diagram of an example of use of the system according to the present invention.

Referring to FIG. 7, one example of the utilisation of the system of the present invention is illustrated in an environment comprising a person, an article and an area. In this example, reference is made to a food preparation environment, although the system is equally suited for use in other hygiene, manufacturing, security or other environment as desired or as appropriate. In a food preparation environment, possible sources of contact include workers, visitors, utensils, white goods, and the like and also preparation or storage areas. In this example, reference is made to the sources of contact comprising a worker 21, utensil 22, preparation area 23 and sink 24.

A monitoring device 7*a*, 7*b*, 7*c*, 7*d* is connected to the worker 21, utensil 22, preparation area 23 and sink 24 respectively. Each of the monitoring devices 7*a*, 7*b*, 7*c*, 7*d* comprise respective indicator units 8*a*, 8*b*, 8*c*, 8*d* and respective detecting units 9*a*, 9*b*, 9*c*, 9*d*. The indicator units 8*a*, 8*b*, 8*c*, 8*d* comprise electrical contacts 12*a*, 12*b*, 12*c*, 12*d* and are substantially as described above. The electrical contacts 12*a*, 12*b*, 12*c*, 12*d* are in contact with a conducting surface of the respective source of contact 21, 22, 23, 24 and apply an electrical signal thereto. The electrical signal can contain encoded information unique to the source 21, 22, 23, 24. Indicator unit 8*c* associated with monitoring device 7*c* also emits a radio frequency signal in addition to an electrical signal. The radio frequency signal contains encoded information unique to the source 23. Detecting units 9*a*, 9*b*, 9*c*, 9*d* are all operable to detect electrical signals emitted by indicator units 8*a*, 8*b*, 8*c*, 8*d* and radio frequency signals emitted by indicator unit 8*c*. The detecting units 9*a*, 9*b*, 9*c*, 9*d* comprise respective electrical contacts 15*a*, 15*b*, 15*c*, 15*d* in electrical connection with the surface of the sources 21, 22, 23, 24 and receivers 16*a*, 16*b*, 16*c*, 16*d*. The receivers 16*a*, 16*b*, 16*c*, 16*d* each comprise an electrical signal receiver and a radio frequency receiver, and are thus suitable for receiving electrical signals of the type emitted by indicator units 8*a*, 8*b*, 8*c*, 8*d* and radio frequency signals of the type emitted by indicator unit 8*c*. The detecting units 9*a*, 9*b*, 9*c*, 9*d* also comprise respective processing units 17*a*, 17*b*, 17*c*, 17*d* which are operable to identify the signals received by receivers 16*a*, 16*b*, 16*c*, 16*d*. The processing units 17*a*, 17*b*, 17*c*, 17*d* can identify the signals as originating from indicator units 8*a*, 8*b*, 8*c*, 8*d* of different monitoring device 7*a*, 7*b*, 7*c*, 7*d* to their own. Thus, contact between at least two sources 21, 22, 23, 24 can be determined.

Each of the detecting units 9*a*, 9*b*, 9*c*, 9*d* comprise respective transmitters 18*a*, 18*b*, 18*c*, 18*d* in communication with a management unit 20. Accordingly, the processing unit 17*a*, 17*b*, 17*c*, 17*d* can output an information signal to the transmitters 18*a*, 18*b*, 18*c*, 18*d* which transmit the information to the management unit 20. Such communication can be by a radio frequency signal.

Further, each detecting unit 9*a*, 9*b*, 9*c*, 9*d* also comprise respective status display units 19*a*, 19*b*, 19*c*, 19*d* in connection with respective processing units 17*a*, 17*b*, 17*c*, 17*d*. Thus, in addition to the processing unit 17*a*, 17*b*, 17*c*, 17*d* outputting an information signal to the management unit 20, it can also transmit an information signal to the respective status display unit 19*a*, 19*b*, 19*c*, 19*d*.

Thus, in operation, the worker 21 will have the monitoring device 7*a* attached about his person. When the worker 21 enters the storage area 23, the receiver 16*a* detects the radio frequency signal emitted by the radio frequency transmitter 13*c* of indicator 8*c*. The detected signal is identified by processing unit 17*a* as being from indicator 8*c*. The information encoded within the radio frequency signal is processed by processing unit 17*a* and output to transmitter 18*a*. The transmitter 18*a* can transmit this information to the management unit 20 where it is recorded. The information recorded by the management unit 20 comprises information identifying the source 23 of the initial radio frequency signal and the source 21 detecting the signal. Thus, the monitoring device 7*a* has identified contact between the worker 21 and the storage area 23. In addition, the signal emitted by the indicator unit 8*a* can be detected by the detecting unit 9*c* associated with the storage area 23. The electrical signal applied to the skin of the worker 21 may be detected by the receiver 16*c* when the worker contacts a surface within the area 23. The electrical signal applied to the skin of the worker 21 may in some instances pass through an intermediary object, such as an installation (not shown), when the worker 21 contacts that object, and subsequently be detected by the receiver 16*c* also in contact with the intermediary object. Thus, contact between the worker 21 and storage area 23 can be inferred and subsequently recorded by the management unit 20. This provides for a means of cross-referencing information stored by the management unit 20.

By the same means as described in relation to the worker 21 and the storage area 23, the presence of contact between the utensil 22 and the storage area 23 can be monitored and recorded by the management unit 20. It is therefore possible to monitor when the utensil 22 is in the storage area 23.

Similarly, the contact between the worker 21 and the utensil 22 can be monitored and recorded. When the worker 21 picks up the utensil 22, the receiver 16*a* detects the signal emitted across the surface of the utensil 22 by the emitter 13*h* of the indicator unit 8*b*. Correspondingly, the receiver 16*b* also detects the same contact resulting from the signal emitted across the surface of the worker 21 by the emitter 13*a*. In both instances, the information is processed by the respective processing units 17*a*, 17*b* and is output to the transmitters 18*a*, 18*b* and transmitted to the management unit 20. Thus, a record of the contact between the worker 21 and the utensil 22 is recorded and logged. Again, the recorded information can identify the worker 21 and the utensil 22. This is particularly useful for maintaining an audit of the use of a utensil within an area by a worker, or the location of a worker within an environment.

As described in relation to contact between the worker 21 and the utensil 22, contact between the worker 21 and/or utensil 22 and the sink 24 can be monitored. This can be used to monitor adequate washing of the hands of the worker 21 or the utensil 22.

The emitter 13*d* emits an electrical signal across the surface of the sink 24 and/or into the water flow of an associated tap. When the worker 21 washes his hands, an electrical pathway between the indicator unit 8*d* and the detecting unit 9*a* is established. The receiver 16*a* detects the signal and the processing unit 17*a* processes the information. Correspondingly, the receiver 16*d* also detects the contact resulting from the signal emitted across the skin of the worker 21 by the emitter 13*a*.

In such an example, the risk of contamination of the worker 21 and the utensil 22 can be monitored. Upon initial contact between the worker 21 and the utensil 22, the signals emitted by emitters 13*a*, 13*b* may be processed by processing units 17*a*, 17*b* and a level of contamination risk determined. The level of contamination risk of a particular source may be stored in the memory 14*a*, 14*b* of the respective indicator units 8*a*, 8*b*. An indication of the risk of contamination may be output from the processing units 17*a*, 17*b* to the respective status display units 19*a*, 19*b*. Thus, upon contact with the utensil 22, the risk of contamination of the worker 21 and the utensil 22 may both be set to high. This will be indicated by the status display units 19*a*, 19*b* as a red light. When the worker 21 washes his hands in the sink 24, or washes the utensil 22 in the sink 24, the signal emitted by emitter 13*d* is detected by the receivers 16*a*, 16*b* and processed by processing units 17*a*, 17*b*.

In such an example, the monitoring devices 7*a*, 7*b*, 7*c*, 7*d* comprise respective sensors 33*a*, 33*b*, 33*c*, 33*d* (not shown) in communication with respective indicator units 8*a*, 8*b*, 8*c*, 8*d*, as desired or appropriate. The sensors 33*a*, 33*b*, 33*c*, 33*d* are operable to determine the duration of contact between the sources. The duration of contact can be encoded within the signal emitted by respective emitters 13*a*, 13*b*, 13*c*, 13*d* and thus detected by respective receivers 16*a*, 16*b*, 16*c*, 16*d*, processed by respective processing units 17*a*, 17*b*, 17*c*, 17*d* and output to respective transmitters 18*a*, 18*b*, 18*c*, 18*d*. The information relating to the contact can thus be recorded by management unit 20. Thus, the processing units 17*a*, 17*b* may determine the contact quality between the sources 21, 22, 24, adjust the level of contamination risk and output an information signal indicative thereof to the status display units 19*a*, 19*b*.

If the washing in sink 24 is of a sufficient duration, the status display unit may output a green light to indicate that the worker 21 and/or utensil 22 present a low risk of contamination. If the contact between the worker 21 and/or utensil 22 and the sink 24 is not of a sufficient duration, the processing unit 17*a*, 17*b* may determine that the contact was not of a sufficient quality, i.e. the worker 21 or the utensil 22 was not washed for a sufficient duration of time. Thus, the processing unit 17*a*, 17*b* may maintain the contamination risk as high or adjust the contamination risk to medium, and output an information signal indicative thereof. The status display units 19*a*, 19*b* may output an amber light to indicate medium risk.

Figure 8:
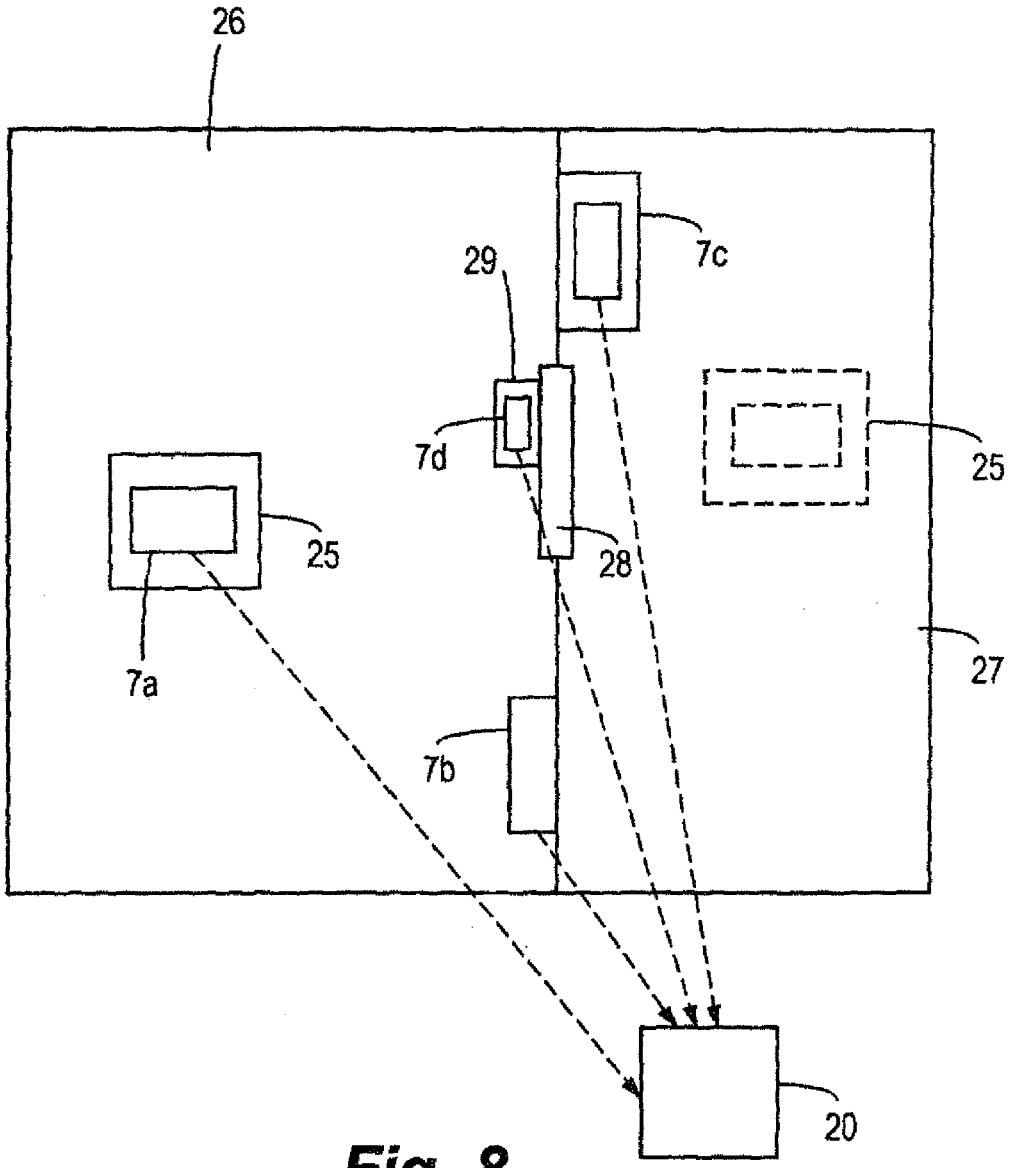
FIG. 8 is a schematic block diagram of an example of use of the system according to the present invention.

Referring to FIG. 8, another example of the utilisation of the system of the present invention is illustrated in an environment comprising a person and two areas. Such a system could be utilised where the location of a person is to be monitored. In this example, reference is made to a person 25, a first area 26 and a second area 27.

A monitoring device 7*a*, 7*b*, 7*c* is connected to the person 25, first area 26 and second area 27 respectively. Each monitoring device 7*a*, 7*b*, 7*c* comprises the features as described previously with respect to the example illustrated in FIG. 7.

Thus, in operation the person 25 enters the first area 26. The receiver 16*a* detects the radio frequency signal emitted by the indicator unit 8*b*. The detected signal is identified by the processing unit 17*a* as being from indicator 8*b*. The information encoded within the radio frequency signal is processed by processing unit 17*a* and output to transmitter 18*a*. The transmitter 18*a* can transmit this information to the management unit 20 where it is recorded. Thus, the monitoring device 7*a* has identified the presence of the person 25 within the first area 26.

Once the person 25 proceeds through the door 28 into the second area 27, the receiver 16*a* will detect the radio frequency signal emitted by the indicator unit 8*c*. As above, the detected signal is identified and processed by the processing unit 17*a* and output to the transmitter 18*a*. The transmitter 18*a* can then transmit this information to the management unit 20. Thus, the location of the person 25 within an environment can be monitored as the person 25 proceeds from one area 26, 27 to another.

If the second area 27 is a restricted area, for example, the locking mechanism of door 28 may be connected to a third source of contact 29 being an access means. Access means 29 comprises monitoring device 7*d* comprising an indicator unit 8*d*, detecting unit 9*d* and the other features as referred to hereinbefore. When the person 25 comes into sufficiently close proximity to the access means 29, the signal emitted by the indicator unit 8*a* is detected by the receiver 16*d*. The processing unit 17*d* can identify the source of the signal and determine whether entry into the second area 27 should be permitted. The processing unit 17*d* can output an indication indicative thereof to the transmitter 18*d*. The transmitter 18*d* can transmit a signal to the management unit 20. In addition, the signal transmitted by the transmitter 18*d* can be received by an access means (not shown) operable to lock and unlock the door 28. At the same time, the processing unit 17*d* can output a signal to a status display unit 19*d*. The status display unit 19*d* may show whether the person 25 is allowed access or not. Such display may take the form of a green light if access is permitted and a red light if access is denied.

It is of course to be understood that the invention is not to be restricted to the details of the above embodiments which are described by way of example only.

The invention claimed is:

1. A system suitable for monitoring contact between a plurality of sources of contact within an environment, the system comprising:

a monitoring device connected to each of the plurality of sources, each monitoring device comprising an indicator unit and a detecting unit, the indicator unit being operable to emit an electrical signal, and the detecting unit being operable to detect and identify electrical signals of a type emitted by another indicator unit of another monitoring device upon contact between at least two of the plurality of sources, wherein the contact is from a physical contact between the at least two of the plurality of sources and output an information signal indicative of the type.

2. A system as claimed in claim 1, wherein each of the plurality of sources is a person, an article or an area.

3. A system as claimed in claim 1, wherein the electrical signal is indicative of the type of source, wherein the type of the source is a person, an article, or an area.

4. A system as claimed in claim 1, wherein each indicator unit emits an electrical signal unique to its source.

5. A system as claimed in claim 1, wherein each indicator unit is operable to emit an electrical signal incorporating a unique identification code.

6. A system as claimed in claim 1, wherein the detecting unit only outputs the information signal if the electrical signal detected from the another monitoring device is different from the electrical signal emitted by the indicator unit of a same monitoring device.

7. A system as claimed in claim 1, wherein the detecting unit only detects an electrical signal with a signal strength that exceeds a threshold level and/or a signal duration that exceeds a preset period.

8. A system as claimed in claim 7, wherein the threshold level includes a determination of a quality of the contact between the at least two of the plurality of sources, the quality being based on a strength and/or a duration of the detected electrical signal.

9. A system as claimed in claim 7, wherein the determination of the quality involves extracting information from the detected electrical signal or another electrical signal.

10. A system as claimed in claim 1, wherein the detecting unit classifies the contact between the at least two of the plurality of sources according to a suitable classification scheme.

11. A system as claimed in claim 10, wherein the classification scheme has a number of different levels depending on an associated risk resulting from the contact between the at least two of the plurality of sources.

12. A system as claimed in claim 11, wherein the classification varies from one level to another in response to each contact.

13. A system as claimed in claim 1, wherein the monitoring device is provided with a status display unit for outputting a visual indication of the contact between the at least two of the plurality of sources.

14. A system as claimed in claim 13, wherein the indication displayed by the status display unit comprises a colour, pattern, text, symbol or any combination thereof.

15. A system as claimed in claim 13, wherein the status display unit comprises one or more illuminable elements, which vary their illumination in response to variation in the information signal.

16. A system as claimed in claim 15, wherein the status display unit is operable to change colour to indicate a different level of classification.

17. A system as claimed in claim 15, wherein the status display unit is operable to output an audio indication of the contact between the at least two of the plurality of sources.

18. A system as claimed in claim 15, wherein the status display unit is an integral part of the monitoring device, or comprises a separate article in communication with the monitoring device.

19. A system as claimed in claim 1, wherein the signal further comprises a radio frequency signal.

20. A system as claimed in claim 19, wherein the indicator unit comprises an electrical signal emitter and a radio frequency transmitter, thus being operable to emit both electrical and radio frequency signals.

21. A system as claimed in claim 1, wherein the detecting unit comprises an electrical signal receiver and a radio frequency receiver, thus being operable to detect both electrical and radio frequency signals.

22. A system as claimed in claim 1, wherein the monitoring device is provided with attachment means enabling attachment to the source.

23. A system as claimed in claim 22, wherein the attachment means further comprises one or more electrical surfaces enabling electrical connections to be made between the monitoring device and the source.

24. A system as claimed in claim 1, wherein the system further comprises a management unit.

25. A system as claimed in claim 24, wherein the management unit is in one way or two way communication with one or more monitoring devices.

26. A system as claimed in claim 25, wherein the monitoring device is operable to transmit the information signal to the management unit.

27. A system as claimed in claim 26, wherein the management unit is operable to store a record of contact between two or more sources over time.

28. A system as claimed in claim 24, wherein the management unit is in one way or two way communication with one or more status display units.

29. A system as claimed in claim 1, wherein the monitoring device comprises a package adapted to be carried about a person, affixed to an article, or affixed to a wall of an area.

30. A method of monitoring contact between a plurality of sources of contact within an environment, the method comprising:

attaching monitoring devices to each source, the monitoring devices each comprising an indicator unit and a detecting unit;

detecting electrical signals of a type emitted by another indicator unit of another monitoring device with a detecting unit of a given monitoring device, wherein the detected electrical signal indicates a detection of contact between at least two of the plurality of sources, the contact being from a physical contact between the at least two of the plurality of sources; and outputting an information signal indicative of the detected electrical signal.

31. A monitoring device suitable for monitoring contact between a plurality of sources of contact within an environment, the monitoring device comprising:

an indicator unit;

a detecting unit;

a connection means for connecting the monitoring device to a source of the plurality of sources;

wherein the detecting unit comprises a receiver operable to detect electrical signals of a type emitted by other indicator units; and a processing unit operable to identify a detected electrical signal and output an information signal indicative of the detected electrical signal.

* * * * *